US011794373B2

(12) United States Patent
Schürmann et al.

(10) Patent No.: US 11,794,373 B2
(45) Date of Patent: Oct. 24, 2023

(54) METHOD FOR PROCESSING FLAT WORKPIECES

(71) Applicant: IMA Schelling Deutschland GmbH, Lübbecke (DE)

(72) Inventors: Ralf Schürmann, Stemwede (DE); Michael Schmöe, Minden (DE); Thorsten Kühl, Espelkamp (DE)

(73) Assignee: IMA Schelling Deutschland GmbH, Lübbecke (DE)

( * ) Notice: Subject to any disclaimer, the term of this patent is extended or adjusted under 35 U.S.C. 154(b) by 317 days.

(21) Appl. No.: 17/295,180

(22) PCT Filed: Dec. 9, 2019

(86) PCT No.: PCT/EP2019/084120
§ 371 (c)(1),
(2) Date: May 19, 2021

(87) PCT Pub. No.: WO2020/120352
PCT Pub. Date: Jun. 18, 2020

(65) Prior Publication Data

US 2021/0387375 A1 Dec. 16, 2021

(30) Foreign Application Priority Data

Dec. 10, 2018 (DE) ..... 102018131527.9

(51) Int. Cl.
*B27M 1/08* (2006.01)
*B27B 5/06* (2006.01)
*B27C 9/00* (2006.01)

(52) U.S. Cl.
CPC ..... *B27M 1/08* (2013.01); *B27B 5/06* (2013.01); *B27C 9/00* (2013.01)

(58) Field of Classification Search
CPC ..... B27B 5/06; B27B 29/00; B27B 29/02; B27B 31/00; B27B 31/08; B27C 5/06;
(Continued)

(56) References Cited

U.S. PATENT DOCUMENTS 5,064,048 A * 11/1991 Becker ..... B27M 1/08 83/423
7,966,714 B2 * 6/2011 Dick ..... B27M 1/08 144/360

(Continued)

FOREIGN PATENT DOCUMENTS

AT 402193 B 2/1997
AT 500768 A1 3/2006

(Continued)

*Primary Examiner* — Katrina M Stransky
*Assistant Examiner* — Jared O Brown
(74) *Attorney, Agent, or Firm* — Laurence P. Colton; SMITH TEMPEL BLAHA LLC

(57) ABSTRACT

A method for processing plate-shaped workpieces made of wood or wood substitute materials, having the following steps: providing a large-format plate made of wood or wood substitute materials, and supplying the large-format plate to an isolation station; isolating plate-shaped workpieces by dividing the provided large-format plate in the isolation station such that cuts are made in the large-format plate by at least one isolation unit; supplying the isolated workpieces to at least one downstream machining station, in order to finish the isolated workpieces. At least a portion of each isolated workpiece receives, from the isolation unit, an alignment portion having at least one reference drilled hole for engagement of gripping elements. The isolated workpiece provided with the alignment portion is received by means of a gripping element, an engagement element or an acquisition element engaging on the alignment portion, following the separation of the isolated workpiece.

14 Claims, 4 Drawing Sheets

(58) Field of Classification Search
CPC ... B27M 1/08; B27D 1/04; B27D 1/06; B27D 1/08; B23D 47/04; B23D 47/042; B65G 47/22; B23Q 7/18; B23Q 3/00; B25B 11/00
See application file for complete search history.

(56) References Cited

U.S. PATENT DOCUMENTS

| | | | | |
|---|---|---|---|---|
| 8,245,742 | B2 * | 8/2012 | Filion | B27M 1/08 144/350 |
| 2008/0099105 | A1 * | 5/2008 | Kelly | B27M 1/08 144/373 |

FOREIGN PATENT DOCUMENTS

| | | | |
|---|---|---|---|
| DE | 102008032160 | A1 | 1/2010 |
| DE | 102014204695 | A1 | 9/2015 |
| DE | 102016203674 | A1 | 9/2017 |
| DE | 102017002271 | A1 | 9/2018 |
| WO | 2018104532 | A1 | 6/2018 |

* cited by examiner

METHOD FOR PROCESSING FLAT WORKPIECES

CROSS REFERENCE TO RELATED APPLICATIONS

This patent application is the US National Phase of and claims priority on and the benefit of International Application No. PCT/EP2019/084120 having an international filing date of 9 Dec. 2019, which claims priority on and the benefit of German Patent Application No. 10 2018 131 527.9 having a filing date of 10 Dec. 2018.

BACKGROUND OF THE INVENTION

Technical Field

The invention relates to a method for processing plate-shaped workpieces, in particular made of wood or wood substitute materials, in which method the following steps are carried out: a) providing a large-format plate, in particular made of wood or wood substitute materials, and supplying the large-format plate to an isolation station; b) isolating plate-shaped workpieces by dividing the provided large-format plate in the isolation station, in that cuts are made, here, in the large-format plate by at least one isolation unit; and c) supplying the workpieces, thus isolated, to at least one downstream machining station, in order to finish the plate-shaped workpiece, as are known for example from WO 2018/104532 A1 or AT 402 193 B.

Prior Art

AT 500 768 A1 discloses a machining device comprising different units for sawing, milling, or drilling. In this case, the workpieces are aligned by means of stops and the machining devices are positioned accordingly.

Since in facilities of this kind machining units which are not currently in use are idle, the isolation and the reworking are currently spatially separated. In known methods of this kind, plate-shaped workpieces are typically provided at the start of the production as a large-format plate. The mentioned large-format plate is to be isolated, in an isolation station, according to a cutting plan. The isolated plates are then discharged from the isolation station and are passed to downstream machining units.

DE 10 2008 032 160 A1 discloses a method for plate division, in which markings are introduced, a separating step takes place, and the separated workpieces are released for further separation, where they are rotated manually by 90° and returned to the machine for the subsequent cutting. There, they are aligned, finally cut to size, and released again, where they are deposited by hand.

DE 10 2014 204 695 A1 discloses an image acquisition method for an isolation/machining device, the image acquisition acquiring the size and the machining state, and issuing therefrom stacking provisions for manual stacking for further processing. DE 10 2016 203 674 A1 discloses a workpiece acquisition system which determines, for the user, instructions for further treatment.

As part of the increasing automation and the increasing demands with respect to manufacture in batch size 1, the requirements of the process speed are also constantly increasing. A problem of known isolation stations is that, as disclosed in DE 10 2017 002 271 A1, the component in question has to essentially be newly aligned and optionally stretched in a defined alignment in the case of transfer to a downstream machining station. Thus, upon takeover of the isolated workpiece, the downstream machining station must first align said workpiece in order to be able to machine it according to the plan.

This step of course requires time, which reduces the process speed, since the time during which a workpiece is travelling from being cut out of the large-format plate to being picked in a corresponding wood processing facility, is decisive for the process speed.

BRIEF SUMMARY OF THE INVENTION

The object of the invention is therefore that of specifying a method for processing plate-shaped workpieces, by means of which method the above-described disadvantages can be minimized, in particular the process speed is increased and the manufacture of batch size 1 is promoted by improving the material flow.

This object is achieved by a method for processing plate-shaped workpieces, in particular made of wood or wood substitute materials, in which method the following steps are carried out: a) providing a large-format plate, in particular made of wood or wood substitute materials, and supplying the large-format plate to an isolation station; b) isolating plate-shaped workpieces by dividing the provided large-format plate in the isolation station, in that cuts are made, here, in the large-format plate by at least one isolation unit; and c) supplying the workpieces, thus isolated, to at least one downstream machining station, in order to finish the plate-shaped workpiece, characterized in that, in step b) at least a portion of each isolated workpiece is provided, by the isolation unit, with an alignment portion for engagement of gripping elements, the alignment portion having at least one reference drilled hole, the workpiece provided with the alignment portion being received by means of a gripping element, an engagement element or an acquisition element engaging on the alignment portion, following the separation of said workpiece. Advantageous embodiments can be found in the dependent claims.

In the case of the method according to the invention for processing plate-shaped workpieces, in particular made of wood or wood substitute materials, the following steps are carried out:

a) providing a large-format plate, in particular made of wood or wood substitute materials, and supplying the large-format plate to an isolation station,
b) isolating plate-shaped workpieces by dividing the provided large-format plate in the isolation station, in that cuts are made, here, in the large-format plate by at least one isolation unit,
c) supplying the workpieces, thus isolated, to at least one downstream machining station, in order to finish the plate-shaped workpiece.

In this case, according to the invention, in step b) at least a portion of each isolated workpiece is provided, by the isolation unit, with an alignment portion for engagement of gripping elements, the alignment portion having at least one reference drilled hole, the workpiece provided with the alignment portion being received by means of a gripping element, an engagement element or an acquisition element engaging on the alignment portion, following the separation of said workpiece. A gripping element within the meaning of the invention is not only a gripper, but rather any element that is capable of being brought into engagement with the alignment portion, in an interlocking manner or in another manner. A gripping element is thus also an engagement element or an acquisition element. The gripping element, engagement element or acquisition element according to the invention can thus also be an element which is merely designed to pull along the plate-shaped workpiece in question on which the alignment portion is located. Thus if, in the following, merely a gripping element is mentioned, the statements also apply analogously for an engagement element or acquisition element.

Plate-shaped workpieces within the meaning of this invention can be workpieces made of wood or wood substitute materials, but also lightweight plates, plasterboard, fiber cement board, or general plates made of other materials, as well as plates which can be used in particular for automotive development, or in general for use as components for other constructions.

The basic concept of the invention is that of ensuring, already during the isolation process, that the workpiece later separated from the large-format plate already receives a reference for aligning the workpiece in the subsequent process. A reference of this kind can for example be an aligning portion, i.e., a portion protruding beyond the finished format, to be created later, of the separated workpiece, and/or an introduced reference, of any form whatsoever, for example a drilled hole or the like, which is made by a unit in the workpiece or an edge region that is left.

In order that the isolated workpieces, following the isolation, are not transported further in an uncontrolled manner, in particular in a manner of undefined position with respect to the alignment thereof, the workpieces provided with the alignment portion are received by a gripping element, engaging on the alignment portion, following the isolation of said workpieces. In this case, the gripping element takes over the alignment of the workpiece, said gripping element preferably engaging in an interlocking manner on the alignment portion and controlling the workpiece, and in the process preferably transporting said workpiece further, in an aligned manner, to the at least one downstream machining station.

Thus since, according to the invention, a step or partial step for aligning the workpiece is already performed in the isolation process, this does not need to be carried out again in the downstream machining unit, which significantly reduces the process time and, in particular in the case of batch size 1, can contribute to a significant acceleration of the method.

According to the invention, the gripping element, engagement element, or acquisition element comprises a centering or alignment element. This is preferably a bolt or a pin. Then, in step b) or before or after, a reference drilled hole is made for said gripping element, engagement element, or acquisition element in the alignment portion, in which hole the mentioned centering or alignment element then engages. In a preferred method, the gripping element comprises a gripper that engages on the alignment portion.

If the mentioned reference drilled holes have been made, preferably in step b), they can be used for centering and alignment. For this purpose, the gripping element can be equipped with centering or alignment elements, which engage in the corresponding reference drilled holes. Having knowledge of the position and alignment of the gripping elements, the position and alignment of the workpieces can be calculated. This type of alignment can be used in addition to gripping the workpieces, or even used as the only alignment device. Having clearly defined reference points, alignment takes place in a simple and precise manner.

In the case of the method according to the invention, the process time can be reduced still further if further method steps are already carried out in the isolation process, when manufacturing a finished part. For this purpose it may be possible, according to a method variant according to the invention, for at least one final cut to be made by the isolation unit in step b), the alignment portion being provided on a final cut-free part of the relevant isolated workpiece. Of course, a plurality of final cuts can also be provided, depending on the geometry which the separated part is later intended to have. Making final cuts means that these do not have to be carried out during the subsequent machining, and saves further process time because final cuts are already made by the isolation station.

For the purpose of further or alternative process optimization, it may also be possible for isolation units to be designed, in addition to isolating the workpiece, to perform additional machining steps thereon, in particular to make folds, grooves, drilled holes and/or recesses in the workpiece. It is thus possible for machining steps which usually have to be carried out by downstream machining stations to be shifted forward into the isolation station.

The at least one isolation unit of the isolation station preferably comprises at least one milling unit and/or a sawing unit. Other units can, as indicated above, also be provided in the isolation station.

The isolation station preferably comprises a machining table, the isolation unit being mounted thereon so as to be displaceable in a first direction, in particular on a gantry. It is not essential for a gantry to be used; the corresponding displacement means can also be displaceably mounted for example below the machining table surface.

In this case it may be possible for the at least one isolation unit to be displaceable in a second direction, in particular extending perpendicularly to the first direction. Thus, the large-format plate can be fragmented by means of a combination of the movement of the isolation unit and of the plate itself.

In general, it may be possible for the separation of a plate-shaped workpiece out of the large-format plate to be carried out in that the isolation unit is brought into engagement with the large-format plate, and the large-format plate is moved in the first direction and/or the isolation unit is moved in the second direction.

If first of all the isolation at the isolation station has been carried out, it is possible, according to the method according to the invention, for a downstream machining station to be fitted with the isolated workpiece. For this purpose, according to a preferred embodiment of the method according to the invention, at least one of the following machining actions is carried out at the at least one downstream machining station:

i) receiving and aligning an isolated workpiece at the alignment portion;
ii) coating a narrow side of the plate-shaped workpiece with an edge strip;
iii) carrying out a final cut at a narrow side of the plate-shaped workpiece that is not yet finally formatted;
iv) making at least one drilled hole in the plate-shaped workpiece;
v) final machining of the workpiece provided with an edge strip.

The above-mentioned list is not conclusive; of course, other machining steps can additionally also be carried out at one or a plurality of machining stations downstream of the isolation station.

In principle, the downstream machining stations can therefore perform very different activities. In particular, but not exclusively, with respect to the current application case of wood processing it has been found to be preferable for a machining center and/or a continuously operating machine and/or a drilling machine to be used as the at least one downstream machining station.

Insofar as the isolation station is intended to make final cuts, according to a particular variant of the method it may furthermore be possible for waste, resulting in step b) in the region of the final cut, to be discarded before or during step c). This makes it possible in particular for disruptive waste parts to already be disposed of prior to the transfer to a machining station downstream of the isolation station, and to thereby in any case minimize the amount of material flow.

Depending on the activities that the isolation station performs, i.e., whatever shape the alignment portion should be, the alignment portion of a plate-shaped workpiece isolated in step b) can be used in the further machining process for aligning the workpiece in question.

If the alignment portion is no longer required, for example if the workpiece is accordingly aligned in a machining station downstream of the isolation station, during the final machining, it may be possible, according to the method according to the invention, for the alignment portion to be removed by a final cut or in any case by a split cut in or after step c). According to a preferred embodiment of the present invention, the alignment portion is removed in the at least one downstream machining station, in particular in the last machining step.

BRIEF DESCRIPTION OF THE DRAWINGS

The invention will now be explained in greater detail with reference to FIGS. 1 to 3H.

DETAILED DESCRIPTION OF PREFERRED EMBODIMENTS

Figure 1:
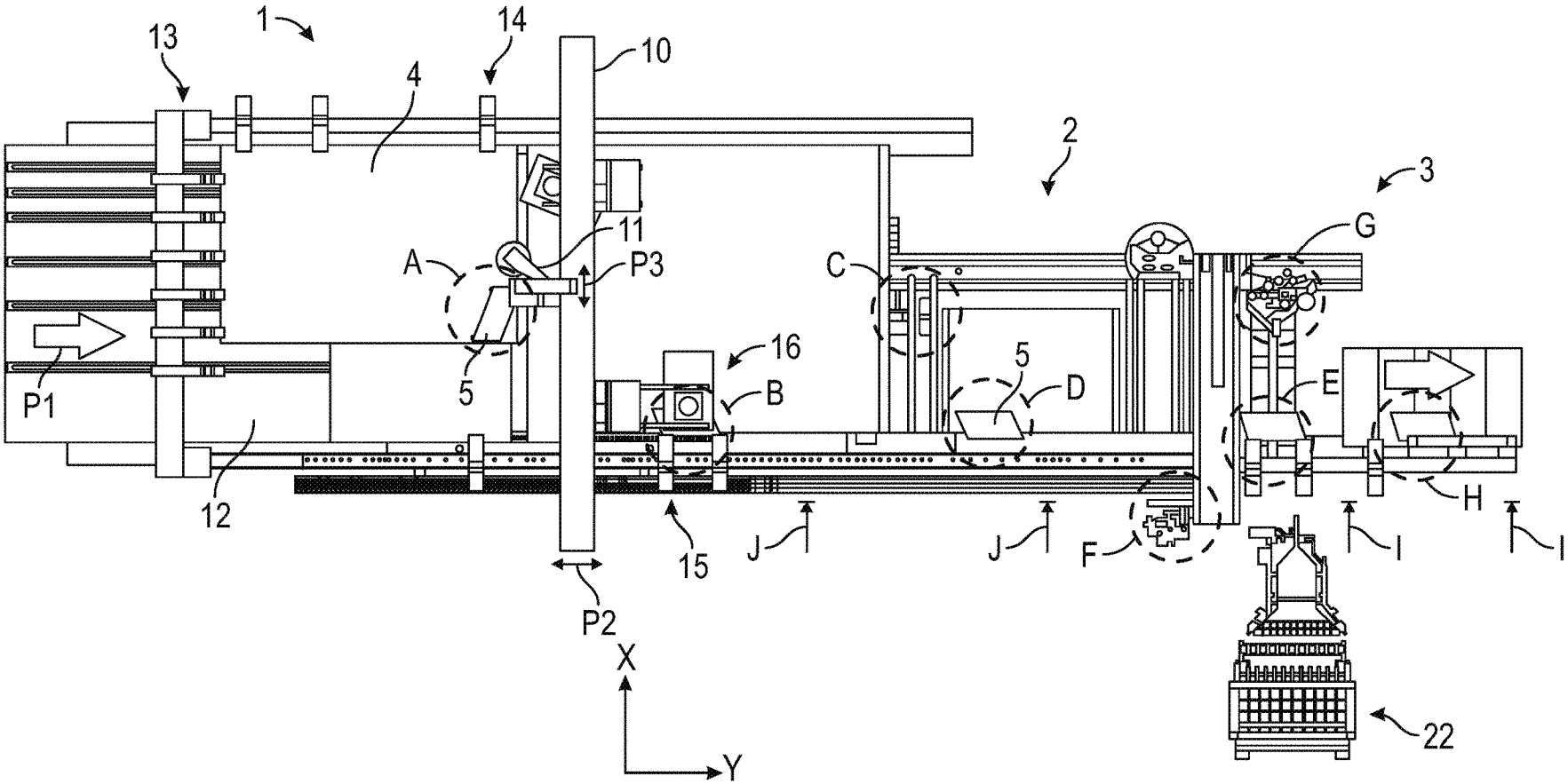
FIG. 1 is a plan view of a device according to the invention, by way of example, for carrying out the method according to the invention.

FIG. 1 shows an overview of a possible device, by means of which the method according to the invention can be carried out. Many other devices are also conceivable.

The following description of individual components of the device shown in FIG. 1 is therefore given merely by way of example, and the components described are optional with respect to the method according to the invention.

All that the method according to the invention requires as essential is for an isolation station 1 to be provided which brings about the isolation of large-format plates 4 into individual isolated workpieces 5, as well as, in addition, for at least one machining station 16, 2, 3 downstream of the isolation station 1 to be provided, at which station the isolated workpiece 5 is treated in any form or otherwise machined. The plate-shaped workpieces within the meaning of the invention are preferably those made of wood or wood substitute materials. Other materials are in principle conceivable.

In the example shown, the isolation station 1 comprises a gantry 10 on which a machining unit 11 is arranged so as to be displaceable back and forth in the direction X (direction of the arrow P3). The gantry 10 itself is displaceable perpendicularly to the extension direction thereof, in the direction Y (arrow P2). The machining unit 11 does not necessarily have to be attached to a gantry 10, however; it can also be arranged on the isolation station 1 in another manner so as to be movable relative to the deposition table 12 of the isolation station 1.

The large-format plate 4 is preferably shifted in the direction of the arrow P1 (in parallel with the direction Y) on the deposition surface of the deposition table 12, and acquired and fixed there by grippers 13 engaging on the transverse side of the large-format plate 4 with respect to the direction Y, and/or grippers 14 engaging on the longitudinal side of the large-format plate 4 with respect to the direction Y. The grippers 13, 14 are preferably displaceable in the direction Y. For the purpose of isolation, the machining unit 11, which may be a milling machine or a saw or another machining unit, inter alia makes cuts by means of which a workpiece 5 is separated out of the large-format plate. In the example shown, this takes place at A (FIG. 3A).

It is now essential for the implementation of the concept of the invention for the isolated workpiece 5, in the isolation station 1, to receive an alignment portion. What an alignment portion may be is explained with reference to FIGS. 2A to 2B, on the basis of the examples there.

Figure 2A:
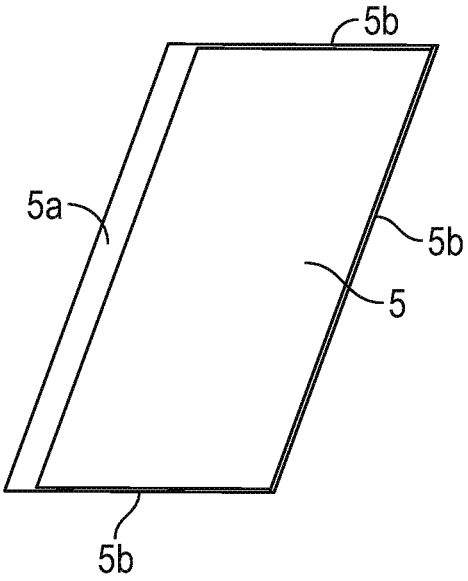
FIG. 2A is a plan view of a workpiece, by way of example, isolated in the isolation station, comprising an alignment portion, in a first embodiment.
Figure 2B:
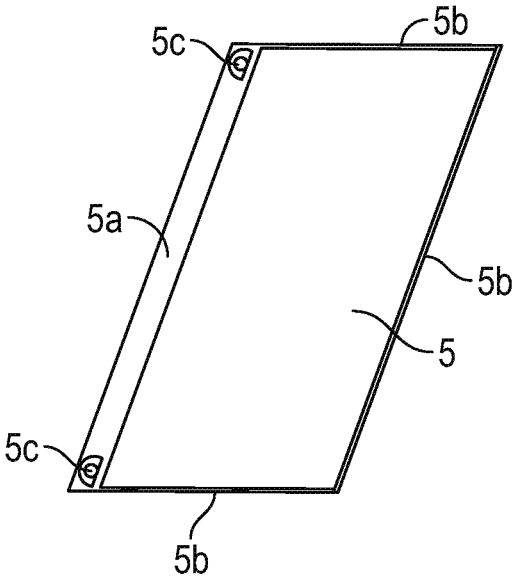
FIG. 2B is a plan view of a workpiece, by way of example, isolated in the isolation station, comprising an alignment portion, in a second embodiment.

Firstly, it is possible, as shown in FIG. 2A, for an alignment portion 5*a* to be a material protrusion for example, which, unlike for example final cuts 5*b* in the case of which the isolated workpiece 5 already has its final format, still have to be separated from the isolated workpiece 5 in a later method step. Alternatively or in addition, however, it is also possible, as shown for example in FIG. 2B, in which the workpiece 5, as also in FIG. 2A, is in the shape of a parallelogram for example, to introduce or attach alignment depressions 5*c* in the workpiece 5, in the region of the isolation station, during the isolation procedure. In the example shown, the alignment depressions 5*c* are for example depressions made by milling or drilling, in which depressions for example corresponding centering or alignment elements can engage gripping means receiving the isolated workpiece 5. Preferably, depressions of this kind are designed in a non-rotationally symmetric manner, such that more or less form-fitting engagement of the mentioned gripping means in the received workpiece 5 can take place, and the gripping means can receive said workpiece in a manner having a defined reference position. The machine controller then knows how accurately the workpiece 5 is aligned in the machine.

Figure 2C:
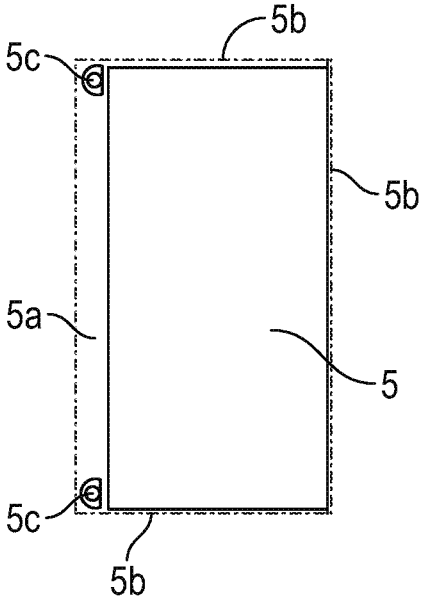
FIG. 2C is a plan view of a workpiece, by way of example, isolated in the isolation station, comprising an alignment portion, in a third embodiment.
Figure 2D:
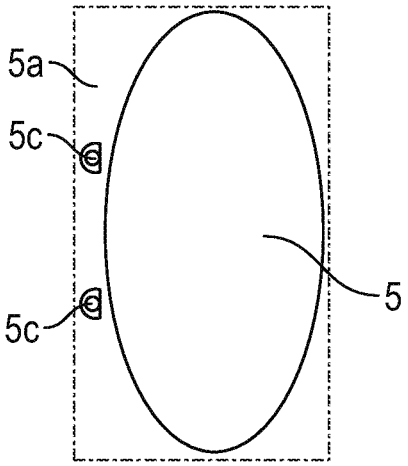
FIG. 2D is a plan view of a workpiece, by way of example, isolated in the isolation station, comprising an alignment portion, in a fourth embodiment.

It is thereby possible, as shown in FIGS. 2C and 2D, in particular if alignment portion 5*a* and alignment depressions 5*c* are combined, to transfer any desired shape (rectangle in FIG. 2C or oval in FIG. 2D), to subsequent machining units, for further machining steps, following the isolation in the isolation station.

Figure 3B:
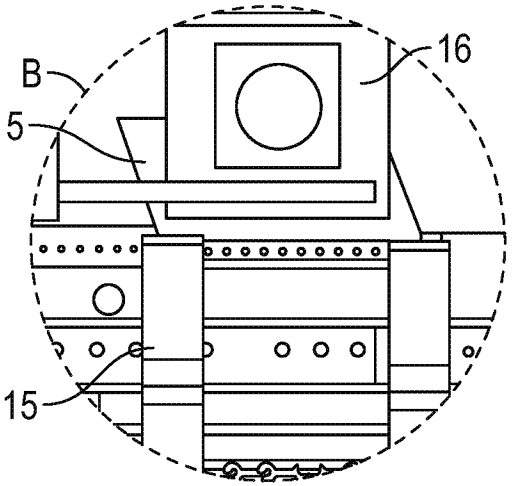
FIG. 3B is an enlarged detail of the detail B from FIG. 1.

A corresponding first transfer is shown for example in detail B of FIG. 1, and the associated FIG. 3B. In this case the already isolated workpiece is received for example by a machining station 16 in the form of a rotation means, and rotated by 90°, and then transferred to the grippers 15 which are preferably displaceable in the direction Y and receive the workpiece at the corresponding alignment portion and optionally transfer said workpiece through the further device. The machine controller knows exactly, at this point, the alignment in which the workpiece 5 is positioned in the machine, and can run the further machining program on the basis thereof. Instead of the grippers 15 and machining station 16, at this point (B) a robot can also be used in the corresponding device, which robot both rotates the workpiece into a specific position, and can grasp the workpiece 5 accordingly at the alignment portion 5*a* or by the final cuts 5*b*.

Figure 3D:
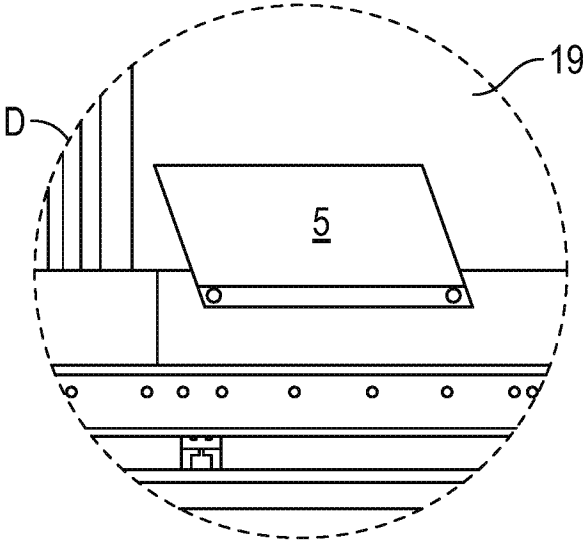
FIG. 3D is an enlarged detail of the detail D from FIG. 1.
Figure 3A:
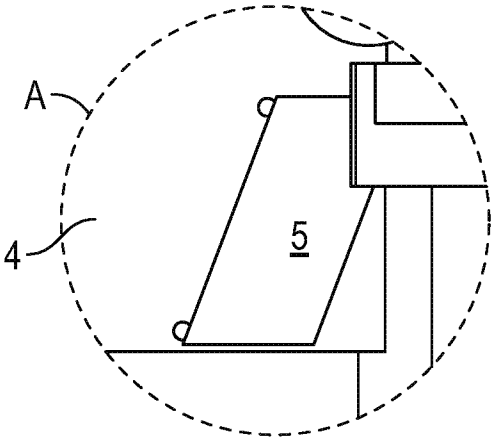
FIG. 3A is an enlarged detail of the detail A from FIG. 1.
Figure 3C:
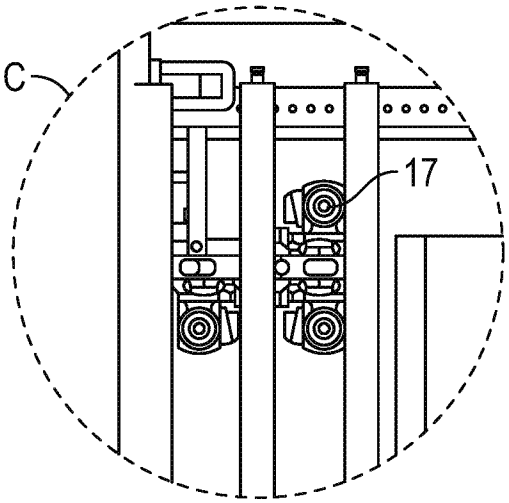
FIG. 3C is an enlarged detail of the detail C from FIG. 1.

A rotation is of course optional. The following machining steps can be combined with one another as desired, or individual machining steps can be omitted. It is possible for example at C (corresponding to FIG. 3C) for milling machining or drilling machining using a corresponding unit 17 (optionally from the underside of the workpiece 5) to be carried out, it being possible for the above-mentioned grippers 15 to be used to retain the workpiece 5 during said machining step. This can also be achieved by means of a robot moving therewith in the Y direction.

At station D (FIG. 3D), the workpiece 5 can for example be placed on a vacuum table 19 or in a buffer, and optionally received by a further group of grippers or tensioners which are movable in the Y direction. At the same time or in addition, at this point the transfer of the workpiece 5 to the transport system or a protection system of the following machining station can take place.

Figure 3F:
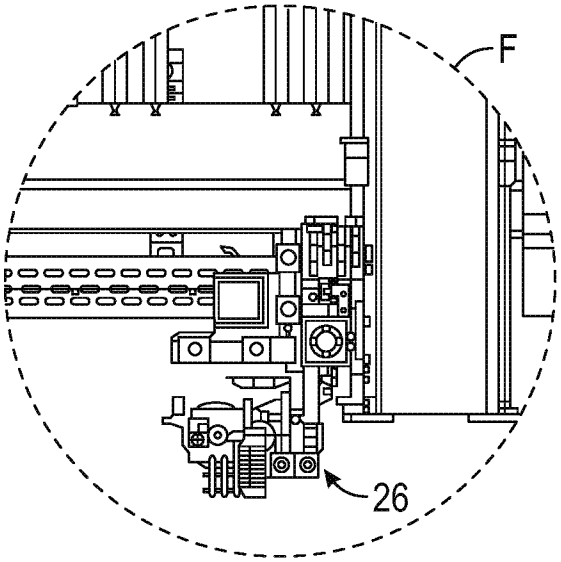
FIG. 3F is an enlarged detail of the detail F from FIG. 1.

There it is optionally possible, for example at F (FIG. 3F), for a further machining unit to be provided, such as a tool changer or a gang drilling head 26 or a gluing unit, which carries out machining steps on the workpiece 5.

Likewise, at station E (FIG. 3E) the workpiece 5 can be retained by corresponding grippers or tensioners 23, 24, and/or displaced in the direction Y, it being possible in this case, for example, for re-machining to be performed from the upper face of the workpiece 5.

Figure 3H:
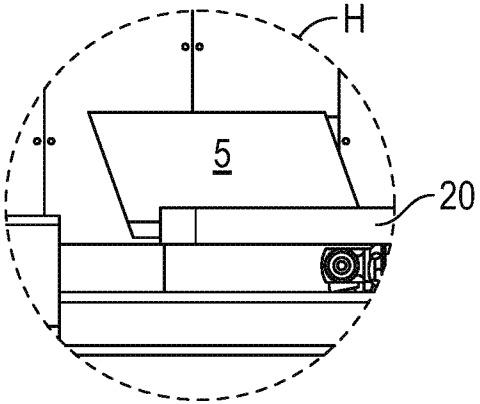
FIG. 3H is an enlarged detail of the detail H from FIG. 1.
Figure 3E:
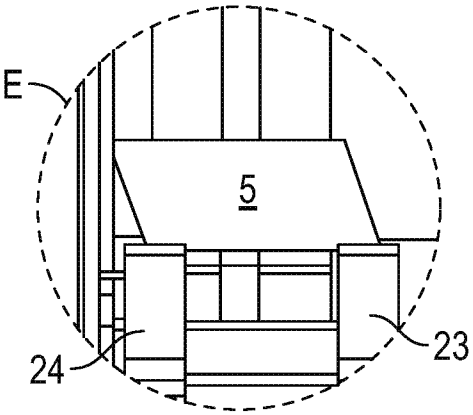
FIG. 3E is an enlarged detail of the detail E from FIG. 1.
Figure 3G:
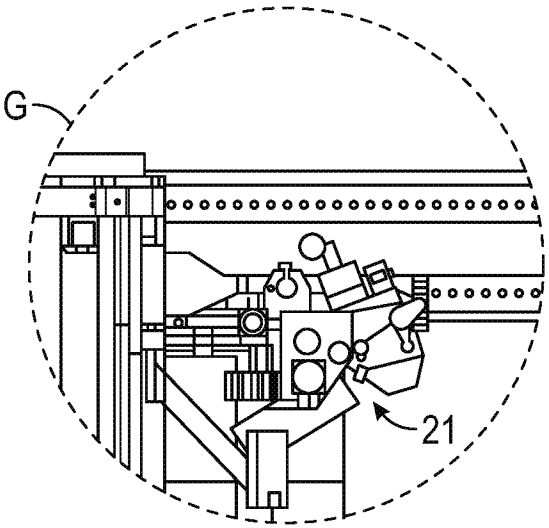
FIG. 3G is an enlarged detail of the detail G from FIG. 1.

A further optional station is station G (FIG. 3G). It is possible, for example, for a gluing unit 21 or attachment unit, fed by an edging magazine 22, to be arranged at this point, which unit is designed for attaching edge strips to the narrow side of the workpiece 5. It is theoretically possible for the attachment to take place at three workpiece narrow sides in this case, specifically everywhere that the workpiece 5 is not retained.

In particular, it is optionally possible for further final cuts to be made on the workpiece 5 in stations B to F.

In the case of station H which is shown in greater detail in FIG. 3H (i.e., preferably at the end of the machining), it is then possible for the alignment portion 5*a* to be removed and the workpiece to be finished for removal at the end. For this purpose, a saw or a milling machine 20 may be provided at this point.

Of course, stations two and three can contain or be designed as both continuous machines and machining centers.

The arrangement according to the invention makes it possible to optimize processing procedures, since auxiliary measures for subsequent alignment and referencing of the workpiece 5 isolated out of the large-format plate 4 are already carried out prior to the actual machining, such that corresponding set-up times during the actual workpiece machining can be avoided.

The invention claimed is:

1. A method for processing plate-shaped workpieces made of wood or wood substitute materials, in which method the following steps are carried out:

a) providing a large-format plate (4) made of wood or wood substitute materials, and supplying (P1) the large-format plate (4) to an isolation station (1);

b) isolating a plate-shaped workpiece (5) from the large-format plate (4) by dividing the provided large-format plate (4) in the isolation station (1), such that cuts are made in the large-format plate (4) by at least one isolation unit (11); and c) supplying the isolated workpiece (5) to at least one downstream machining station (2, 3), in order to finish the isolated workpiece (5), wherein, in step b) at least a portion of the isolated workpiece (5) is provided, by the isolation unit (11), with an alignment portion (5*a*) for engagement of gripping elements (14, 15), the alignment portion (5*a*) having at least one reference drilled hole, wherein the isolated workpiece (5) provided with the alignment portion (5*a*) is received by means of the gripping elements (14, 15), an engagement element, or an acquisition element engaging on the alignment portion (5*a*), following the isolation of the isolated workpiece (5), wherein the gripping elements, the engagement element, or the acquisition element comprises a centering or alignment element that engages the at least one reference drilled hole.

2. The method according to claim 1, wherein the gripping elements (14, 15), the engagement element, or the acquisition element comprises a gripper which engages the alignment portion (5*a*).

3. The method according to claim 1, wherein, in step b), the isolation unit (11) carries out at least one final cut (5*b*), the alignment portion (5*a*) being provided on a final cut-free part of the isolated workpiece (5).

4. The method according to claim 3, wherein waste, resulting from step b) in a region of the final cut (5*b*), is discarded before or during step c).

5. The method according to claim 1, wherein the isolation unit (11) is structured, in addition to isolating the isolated workpiece (5), to carry out additional machining steps on the isolated workpiece (5), the additional machining steps selected from the group consisting of making folds, making grooves, making drilled holes, and making recesses in the isolated workpiece (5).

6. The method according to claim 1, wherein the isolation unit (11) comprises at least one milling unit and/or a sawing unit.

7. The method according to claim 1, wherein the isolation station (1) comprises a machining table (12), the isolation unit (11) being mounted on the machining table (12) so as to be displaceable in a first direction (X, Y) on a gantry (10).

8. The method according to claim 7, wherein the isolation unit (11) is displaceable in a second direction (X) which extends perpendicularly to the first direction (Y).

9. The method according to claim 8, wherein the isolation of the isolated workpiece (5) out of the large-format plate is carried out by bringing the isolation unit (11) into engagement with the large-format plate (4) and the large-format plate is moved in the first direction (Y) and/or the isolation unit (11) is moved in the second direction (X).

10. The method according to claim 1, wherein the following machining actions are carried out at the at least one downstream machining station (2, 3):

i) receiving and aligning the isolated workpiece (5) at the alignment portion (5*a*);

ii) coating a narrow side of the isolated workpiece (5) with an edge strip;

iii) carrying out a final cut at a narrow side of the isolated workpiece (5) that is not yet finally formatted;

iv) making at least one drilled hole in the isolated workpiece (5); and v) final machining of the isolated workpiece (5) that is provided with the edge strip.

11. The method according to claim 1, wherein a machining center and/or a continuously operating machine and/or a drilling machine is used as the at least one downstream machining station (2, 3).

12. The method according to claim 1, wherein the alignment portion (5*a*) of the isolated workpiece (5) is used for aligning the isolated workpiece (5) in a further machining process.

13. The method according to claim 1, wherein the alignment portion (5*a*) is removed by a final cut or a split cut, in or after step c).

14. The method according to claim 1, wherein the alignment portion (5*a*) is removed in the at least one downstream machining station (2, 3) in the last machining step.

* * * * *